US010151184B2

(12) United States Patent
Liu

(10) Patent No.: US 10,151,184 B2
(45) Date of Patent: Dec. 11, 2018

(54) DIRECT DRIVE MOTOR-BASED WALKING BEAM PUMPING UNIT

(71) Applicant: Kunming Liu, Sichuan (CN)

(72) Inventor: Kunming Liu, Sichuan (CN)

( * ) Notice: Subject to any disclaimer, the term of this patent is extended or adjusted under 35 U.S.C. 154(b) by 154 days.

(21) Appl. No.: 15/246,470

(22) Filed: Aug. 24, 2016

(65) Prior Publication Data

US 2018/0010431 A1 Jan. 11, 2018

(30) Foreign Application Priority Data

Jul. 7, 2016 (CN) ..... 2016 1 0529916

(51) Int. Cl.
*E21B 43/12* (2006.01)

(52) U.S. Cl.
CPC ..... *E21B 43/127* (2013.01); *E21B 2043/125* (2013.01)

(58) Field of Classification Search
CPC .. E21B 2043/125; E21B 43/121; F04B 47/14; F04B 49/065
See application file for complete search history.

(56) References Cited

U.S. PATENT DOCUMENTS

| | | | | |
|---|---|---|---|---|
| 2,069,031 | A * | 1/1937 | Fergusson | F04B 47/14 74/591 |
| 9,885,349 | B2 * | 2/2018 | Smith | F04B 47/14 |
| 2012/0020808 | A1 * | 1/2012 | Lawson | E21B 43/127 417/18 |
| 2016/0258261 | A1 * | 9/2016 | Fukuyama | F04B 47/02 |
| 2016/0265321 | A1 * | 9/2016 | Elmer | E21B 47/0008 |
| 2017/0002805 | A1 * | 1/2017 | Williams | F04B 49/20 |
| 2017/0226832 | A1 * | 8/2017 | Mason | E21B 43/127 |
| 2017/0329311 | A1 * | 11/2017 | Al Assad | G05B 19/416 |
| 2018/0010431 | A1 * | 1/2018 | Liu | E21B 43/127 |

FOREIGN PATENT DOCUMENTS

CN 105672950 A * 6/2016

* cited by examiner

*Primary Examiner* — Daniel P Stephenson

(57) ABSTRACT

A direct drive motor-based walking beam pumping unit includes a base; a support is arranged at the upper end of the base; a walking beam is arranged at the upper end of the support; a horsehead is arranged at a first of the walking beam; a lifting rope is arranged on the horsehead and a beam hanger is arranged on the lifting rope; a balance weight is arranged at a second end of the walking beam away from the horsehead; a barrel is arranged at the upper end of the base; a direct drive motor is arranged at the upper end of the barrel.

4 Claims, 1 Drawing Sheet

DIRECT DRIVE MOTOR-BASED WALKING BEAM PUMPING UNIT

CROSS-REFERENCE TO RELATED APPLICATIONS

This present application claims the benefit of Chinese Patent Application No. 201610529916.5 filed on Jul. 7, 2016, the contents of which are hereby incorporated by reference.

FIELD OF THE INVENTION

The Invention relates to the field of pumping unit technology, particularly to a direct drive motor-based walking beam pumping unit.

BACKGROUND OF THE INVENTION

The pumping unit, also known as a "kowtow machine", is a type of mechanical equipment for oil mining, which pumps oil from the well by pressure. The conventional walking beam pumping unit is powered by the cooperation of a motor and a reducer. However, the lubricating oil and the drive belt of the reducer need to be replaced regularly and both the reducer and the drive belt will increase failure rate; moreover, the conventional pumping unit is not energy saving with high motor power, small change of output power and largely increased production cost.

SUMMARY OF THE INVENTION

The Invention is to provide a direct drive motor-based walking beam pumping unit to solve the problems of the prior art.

The Invention uses the following technical schemes to achieve the above purpose:

A direct drive motor-based walking beam pumping unit, comprising a base; a support is arranged at the upper end of the base; a walking beam is arranged at the upper end of the support; a horsehead is arranged at a first end of the walking beam; a lifting rope is arranged on the horsehead and a beam hanger is arranged on the lifting rope; a barrel is arranged at the upper end of the base, wherein, a balance weight is arranged at a seccond end of the walking beam away from the horsehead; a direct drive motor is arranged at the upper end of the barrel; the direct drive motor is connected to a crank through a dual-output motor shaft; a second rotating shaft is arranged on a first end of the crank away from the dual-output motor shaft; a connecting rod is arranged on the second rotating shaft; a beam is arranged at a first end of the connecting rod away from the crank; a beam shaft is arranged on the beam; a first rotating shaft is arranged on the beam shaft and connected to the beam through a linkage; the direct drive motor is electrically connected to a controller through a lead.

The direct drive motor-based walking beam pumping unit, wherein, the balance weight comprises a weight-balancing beam; a mounting base mounted on the walking beam is arranged at the front end of the weight-balancing beam; a mounting plate is arranged at the rear end of the weight-balancing beam; multiple buckle placements are arranged on the mounting plate through buckle structures; a dismountable balancing unit is arranged on each of the buckle placements.

In some embodiments, a staircase is respectively arranged on the support and the barrel.

In some embodiments, the support is connected to the walking beam through a support shaft.

In some embodiments, the support is fixed on the base through locking screws.

In some embodiments, a controller controls a direct drive motor and drives a crank through the direct drive motor; the crank is connected to a beam shaft through a connecting rod and a beam; the beam shaft is connected to a balance weight; with the function of balancing according to the lever principle, the balance weight increases the torque to work. With a simple structure, the Invention cancels the combination of belt, belt pulley and reducer conventionally used in the pumping units, greatly lowering the failure rate of the pumping unit, decreasing the frequency of maintenance and service, reducing the cost in use and improving the production efficiency. Moreover, the direct drive motor-based walking beam pumping unit consumes less power; with a new variable frequency controller, the current and voltage of the motor can be adjusted based on the working condition of the pumping unit, and the output power of the motor is automatically adjusted, achieving the goal of energy saving. When the horsehead is lifted, the direct drive motor works, when the horsehead goes down, the dead load of the horsehead drives the direct drive motor to rotate to generate power in a reversed way which may save over 20% of energy and even more if the generated power can be collected and used. According to the lever principle, the balance weight arranged at a second end of the walking beam away from the horsehead increases the torque, making the direct drive motor consume less power for the same work and thus save more than 2% of energy.

Figure 1:
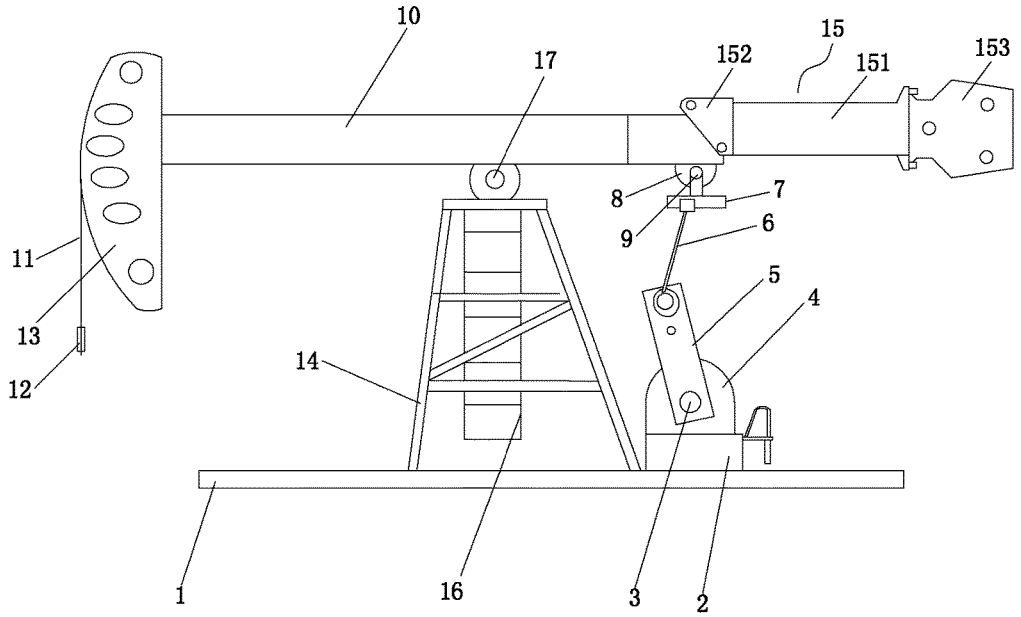
FIG. 1 is a structure diagram of the direct drive motor-based walking beam pumping unit provided by the Invention.

Marks in the drawings are as follows: 1 base; 2 barrel; 3 dual-output motor shaft; 4 direct drive motor; 5 crank; 6 connecting rod; 7 beam; 8 beam shaft; 9 first rotating shaft; 10 walking beam; 11 lifting rope; 12 beam hanger; 13 horsehead; 14 support; 15 balance weight; 16 staircase; 17 support shaft; 151 weight-balancing beam; 152 mounting base; 153 balancing unit; 1511 mounting plate; 1512 buckle structure.

DETAILED DESCRIPTION OF THE INVENTION

A clear and full description of the technical schemes of the embodiments of the Invention will be given in combination of the drawings of the embodiments of the Invention as follows. Obviously, the described embodiments are just a part rather than the whole of the embodiments of the Invention.

Figure 2:
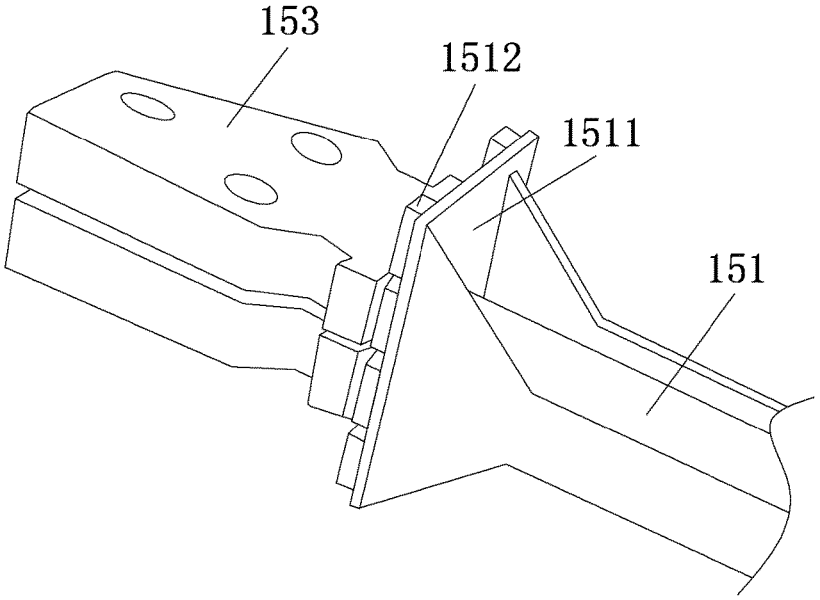
FIG. 2 is a structure diagram of the balance weight described in the Invention.

Refer to FIGS. 1 and 2, a direct drive motor-based walking-beam pumping unit, comprising a base 1, a support 14 is arranged at the upper end of the base 1; the support 14 is fixed on the base 1 through locking screws, increasing the stability of the pumping unit; a walking beam is arranged at the upper end of the support 14 and the support 14 is rotationally connected to the walking beam 10 through a support shaft 17, facilitating the walking beam 10 to rotate for operation. A horsehead 13 is arranged at a first end of the walking beam 10; a lifting rope 11 is arranged on the horsehead 13 and a beam hanger 12 is arranged on the lifting rope 11; A balance weight 15 is arranged at a second end of the walking beam away from the horsehead 13; the balance weight 15 comprises a weight-balancing beam 151; a mounting base 152 mounted on the walking-beam 10 is arranged at the front end of the weight-balancing beam 151; a mounting plate 1511 is arranged at the rear end of the weight-balancing beam 151; multiple buckle placements are arranged on the mounting plate 1511 through buckle structures 1512; a dismountable balancing unit 153 is arranged on each of the buckle placements. The balance weight 15 can be easily dismounted by lifting the other end of the balance weight 15 mounted with the walking beam 10 in a buckle manner; to increase the balance weight 15, more pieces of the balancing unit 153 can be mounted to the buckle structure 1512 on the mounting plate 1511. A barrel 2 is arranged at the upper end of the base 1 and a staircase 16 is respectively arranged on the support 14 and the barrel 2; workers can go up and down through the staircase 16 to adjust the machine; a direct drive motor 4 is arranged at the upper end of the barrel 2; the direct drive motor 4 is connected to a crank 5 through a dual-output motor shaft 3; a second rotating shaft is arranged on a first of the crank 5 away from the dual-output motor shaft 3; a connecting rod 6 is arranged on the second rotating shaft; a beam 7 is arranged at a first of the connecting rod 6 away from the crank 5; a beam shaft 8 is arranged on the beam 7; a first rotating shaft 9 is arranged on the beam shaft 8 and connected to the beam 7 through a linkage; the direct drive motor 4 and the lifting rope 11 is electrically connected to a controller respectively through a lead.

In the Invention, a controller controls a direct drive motor 4 and drives a crank 5 through the direct drive motor 4; the crank 5 is connected to a beam shaft 8 through a connecting rod 6 and a beam 7; the beam shaft 8 is connected to a balance weight 15; with the function of balancing according to the lever principle, the balance weight 15 increases the torque to work. When the horsehead 13 is lifted, the direct drive motor 4 works, when the horsehead 13 goes down, the dead load of the horsehead 13 drives the direct drive motor 4 to rotate to generate power in a reversed way which may save over 20% of energy and even more if the generated power can be collected and used. According to the lever principle, the balance weight arranged at a second of the walking beam 10 away from the horsehead 13 increases the torque, making the direct drive motor 4 consume less power for the same work and thus save more than 2% of energy.

The above are the preferred embodiments rather than the limitations of the protection scope of the Invention. Any equivalent replacement or amendment made within the range of the spirit and rule of the technical scheme of the Invention by a person skilled in the art shall be included in the protection scope of the Invention.

What is claimed is:

1. A direct drive motor-based walking beam pumping unit, comprising a base (1); a support (14) is arranged at the upper end of the base (1); a walking beam (10) is arranged at the upper end of the support (14); a horsehead (13) is arranged at a first end of the walking beam (10); a lifting rope (11) is arranged on the horsehead (13) and a beam hanger (12) is arranged on the lifting rope (11); a barrel (2) is arranged at the upper end of the base (1), wherein, a balance weight (15) is arranged at a second end of the walking beam (10) away from the horsehead (13); a direct drive motor (4) is arranged at the upper end of the barrel (2); the direct drive motor (4) is connected to a crank (5) through a dual-output motor shaft (3); a second rotating shaft is arranged on a first end of the crank (5) away from the dual-output motor shaft (3); a connecting rod (6) is arranged on the second rotating shaft; a beam (7) is arranged at a first of the connecting rod (6) away from the crank (5); a beam shaft (8) is arranged on the beam (7); a first rotating shaft (9) is arranged on the beam shaft (8) and connected to the beam (7) through a linkage; the direct drive motor (4) is electrically connected to a controller through a lead;

wherein, the balance weight (15) comprises a weight-balancing beam (151); a mounting base (152) mounted on the walking beam (10) is arranged at the front end of the weight-balancing beam (151); a mounting plate (1511) is arranged at the rear end of the weight-balancing beam (151) and perpendicular to the weight-balancing beam (151); multiple buckle placements are arranged on the mounting plate (1511) through buckle structures (1512); at least one dismountable balancing unit (153), each dismountable balancing unit (153) being arranged on one of the buckle placements.

2. The direct drive motor-based walking beam pumping unit according to claim 1, wherein, a staircase (16) is respectively arranged on the support (14) and the barrel (2).

3. The direct drive motor-based walking beam pumping unit according to claim 1, wherein, the support (14) is connected to the walking beam (10) through a support shaft (17).

4. The direct drive motor-based walking beam pumping unit according to claim 1, wherein, the support (14) is fixed on the base (1) through locking screws.

* * * * *